US007591876B2

(12) United States Patent
Cameron et al.

(10) Patent No.: US 7,591,876 B2
(45) **Date of Patent: *Sep. 22, 2009**

(54) INJECTION OF SOLIDS INTO LIQUIDS BY MEANS OF A SHROUDED SUPERSONIC GAS JET

(75) Inventors: Andrew Miller Cameron, Tansley (GB); Christian Juan Feldermann, Banyoles (ES)

(73) Assignee: The BOC Group plc, Windlesham (GB)

( * ) Notice: Subject to any disclaimer, the term of this patent is extended or adjusted under 35 U.S.C. 154(b) by 345 days.

This patent is subject to a terminal disclaimer.

(21) Appl. No.: 10/512,187

(22) PCT Filed: Apr. 15, 2003

(86) PCT No.: PCT/GB03/01603

§ 371 (c)(1),
(2), (4) Date: May 25, 2005

(87) PCT Pub. No.: WO03/091461

PCT Pub. Date: Nov. 6, 2003

(65) Prior Publication Data

US 2005/0229749 A1 Oct. 20, 2005

(30) Foreign Application Priority Data

Apr. 24, 2002 (GB) ..... 0209365.6

(51) Int. Cl.
*C22B 9/05* (2006.01)
*C22B 9/10* (2006.01)
*F27D 3/18* (2006.01)
*C21C 7/072* (2006.01)

(52) U.S. Cl. ..... 75/530; 75/533; 266/225

(58) Field of Classification Search ..... 75/528–559; 266/44, 47, 225, 265, 266, 267, 268
See application file for complete search history.

(56) References Cited

U.S. PATENT DOCUMENTS

| | | | |
|---|---|---|---|
| 4,139,370 | A | 2/1979 | Breuer et al. |
| 4,425,223 | A | 1/1984 | Miller |
| 4,434,005 | A | 2/1984 | Metz et al. |
| 4,730,813 | A | 3/1988 | Bock et al. |
| 5,366,537 | A | 11/1994 | Schlichting |
| 6,244,854 | B1 | 6/2001 | Satchell, Jr. et al. |
| 6,250,915 | B1 | 6/2001 | Satchell, Jr. et al. |

(Continued)

FOREIGN PATENT DOCUMENTS

| | | |
|---|---|---|
| EP | 0 866 139 A1 | 9/1998 |

(Continued)

OTHER PUBLICATIONS

Habashi F.: "Handbook of Extractive Metallurgy, vol. I" 1997, Wiley VCH, Weinheim RFG XP002256075 ISBN: 3-527-28792-2 p. 445, left hand column, paragraph First; Figure 7.22; p. 311, Figures 6.61, 6.62; p. 435, Figure 7.17.

*Primary Examiner*—George Wyszomierski
*Assistant Examiner*—Mark L. Shevin
(74) *Attorney, Agent, or Firm*—Joshua L. Cohen

(57) ABSTRACT

A method of introducing a solid particulate reagent into a bath of metallurgical liquid comprises a step of introducing a solid particulate reagent into a main supersonic gas jet. The main supersonic gas jet is directed at the surface of the bath and is surrounded with a jet of shrouding gas, preferably of a burning hydrocarbon fluid fuel, provided at a supersonic velocity. The main supersonic gas jet is formed at a velocity which is in the range of minus 10% to plus 10% of the velocity at which the jet of shrouding gas is formed, preferably in the range of Mach 2 to 3.

7 Claims, 2 Drawing Sheets

U.S. PATENT DOCUMENTS

Figure 1:
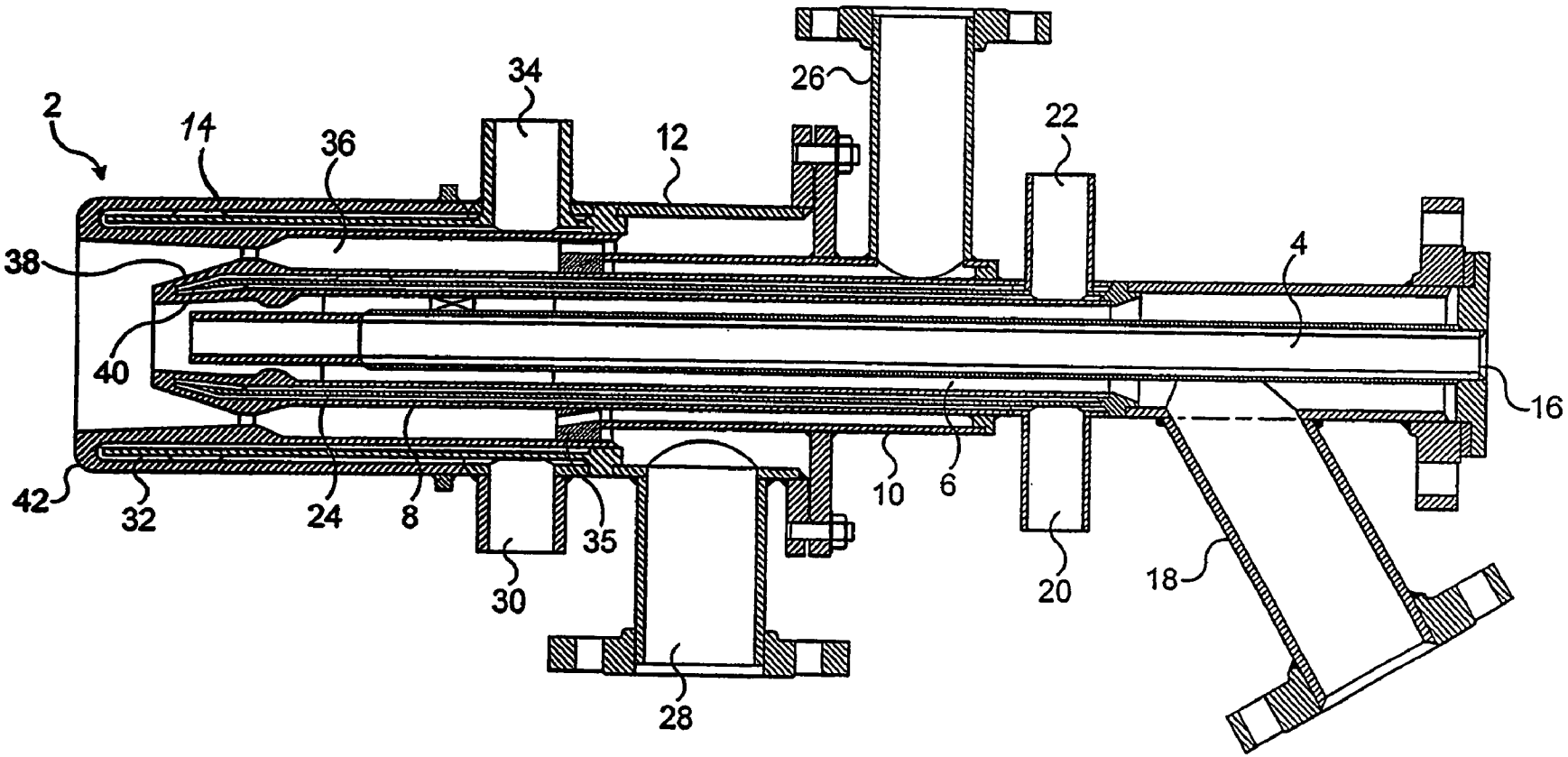

| | | | | |
|---|---|---|---|---|
| 6,322,610 | B1 | 11/2001 | Morsut et al. | |
| 6,409,793 | B1 | 6/2002 | Edlinger | |
| 6,558,614 | B1 * | 5/2003 | Fritz | 266/44 |
| 6,684,796 | B1 * | 2/2004 | Feldermann | 110/347 |
| 2006/0060028 | A1 * | 3/2006 | Cameron et al. | 75/533 |

FOREIGN PATENT DOCUMENTS

| | | | |
|---|---|---|---|
| EP | 0 8741 94 | | 10/1998 |
| EP | 0 0965 649 | | 12/1999 |
| EP | 0 965 649 | A1 * | 12/1999 |
| EP | 1 092 785 | A1 | 4/2001 |
| EP | 0 08 1 448 | | 6/2003 |
| GB | 2 054 655 | A | 2/1981 |
| GB | 2122649 | A | 1/1984 |
| JP | 58-207313 | A | 12/1983 |
| JP | 59-159963 | A | 9/1984 |
| JP | 61-106744 | A | 5/1986 |
| JP | 61-284512 | A | 12/1986 |
| JP | 62-230953 | A | 10/1987 |
| JP | 04-254510 | | 9/1992 |
| JP | 08-092627 | | 4/1996 |

* cited by examiner

INJECTION OF SOLIDS INTO LIQUIDS BY MEANS OF A SHROUDED SUPERSONIC GAS JET

This invention relates to a method for the injection of a particulate solid into a liquid, particularly a metallurgical liquid. The method according to the invention may be employed in metallurgical refining processes such as the manufacture of steel or another ferro-alloy.

It is well known that particulate reagents, particularly carbon, can be injected into a volume ("bath") of metallurgical liquid in a furnace during the refining of the liquid. A problem arises in achieving adequate distribution of the solid particulate reagent in the liquid, especially if the particles are of small size.

It has been proposed to carry a particulate reagent into a metallurgical bath in a supersonic jet of carrier gas. By virtue of its momentum the supersonic jet would be able to penetrate a substantial distance beneath the surface of the bath. The problem arises, however, that on ejection from the nozzle of a conventional metallurgical lance, the jet entrains substantial volumes of gas from the standing surrounding atmosphere and therefore rapidly loses velocity. As a result, the effectiveness of the jet in adequately dispersing the particulate reagent in the bath is diminished.

EP-A-0 874 194 discloses forming a flame at supersonic velocity around a (sub-sonic) stream of carrier gas containing a particulate reagent. The differential velocity between the flame and the carrier gas stream results in the particulate material being entrained in the flame. The effectiveness of the methods disclosed in EP-A-0 874 194 to introduce a particulate solid reagent into a metallurgical bath is therefore limited.

U.S. Pat. No. 6,254,379 B1 discloses employing a high velocity carrier gas jet to introduce solid materials into a reaction zone and to surround the gas jet with a low velocity flame. The reaction zone may be formed in a furnace for the production of molten metal. One disadvantage of this arrangement is that expanding combustion gases are readily drawn into the jet and have the effect of reducing its velocity. Further, U.S. Pat. No. 6,254,379 B1 deliberately selects a long distance of travel for the gas jet to the reaction zone, thereby ensuring that there is a substantial reduction in the velocity of the gas jet before it encounters the reaction zone.

The method according to the invention aims at providing an improved method of introducing a solid particulate material into a bath of a metallurgical liquid which makes it possible to achieve high injection velocities at the point at which the carrier gas enters the bath and minimises mixing of the gas jet with the shroud.

According to the present invention there is provided a method of introducing a solid particulate reagent into a bath of metallurgical liquid, comprising the step of introducing the solid particulate reagent into a main supersonic gas jet, directing the main supersonic gas jet at the surface of the bath, and surrounding the main gas jet with a jet of a shrouding gas, characterised in that the jet of the shrouding gas is also provided at a supersonic velocity and that the main supersonic gas jet is formed at a velocity which is in the range of minus 10% to plus 10% of the velocity at which the jet of shrouding gas is formed, and the shrouding gas jet comprises a burning hydrocarbon fluid fuel.

The method according to the present invention enables the main gas jet to be maintained at high velocity and hence high momentum as it passes to the point at which it enters the bath. The main gas jet is thus able to carry the solid particulate reagent well into the bath. A number of different process advantages can be gained in consequence of this ability of the method according to the present invention to introduce the solid particulate reagent well below the surface of the bath.

The flame resulting from the hydrocarbon fluid fuel preferably terminates at the surface of the bath.

The main supersonic gas jet preferably issues from a first convergent-divergent (or "Laval") nozzle. The jet of shrouding gas is preferably ejected from a second convergent-divergent or Laval nozzle.

Both gas jets preferably leave their respective nozzles at a velocity in the range of Mach 1.5 to 4, more preferably in the range of Mach 2 to 3.

If the jet of shrouding gas is ejected at a higher velocity than the main jet, gas from the latter tends to be entrained in the former. If on the other hand the shrouding gas is ejected at a lower velocity than the main gas jet, the shrouding gas tends to be entrained in the main gas. It is therefore desirable that the main gas jet and the shrouding gas jet are ejected at essentially the same velocity. Provided that this condition is observed, dilution or entrainment of the main gas jet can be kept down. If the two velocities are not the same, it is preferred that the shrouding gas be ejected at the higher velocity because the rate of attenuation of its velocity is greater than that of the shrouded main jet.

Preferably, the combustion of the hydrocarbon commences in a combustion chamber upstream of the second nozzle. Preferably, the particulate solid reagent is introduced into the first nozzle through an axial pipe, which terminates in the divergent section thereof. The main gas jet may be introduced into the metallurgical bath perpendicularly or at an angle to the perpendicular.

In a refining operation, typically one in which the carbon content of the bath is adjusted, the bath includes a surface layer of molten slag. On some occasions it will be desirable to have the solid particulate material penetrate the slag layer and enter the molten metal directly. On other occasions, it is sufficient for the solid particulate reagent to be introduced directly into the slag layer. If penetration into the molten metal is required a higher ejection velocity is selected than if it is not necessary for the particulate material to be carried beneath the slag layer.

The solid particulate material may be introduced continuously or intermittently into the bath.

Figure 2:
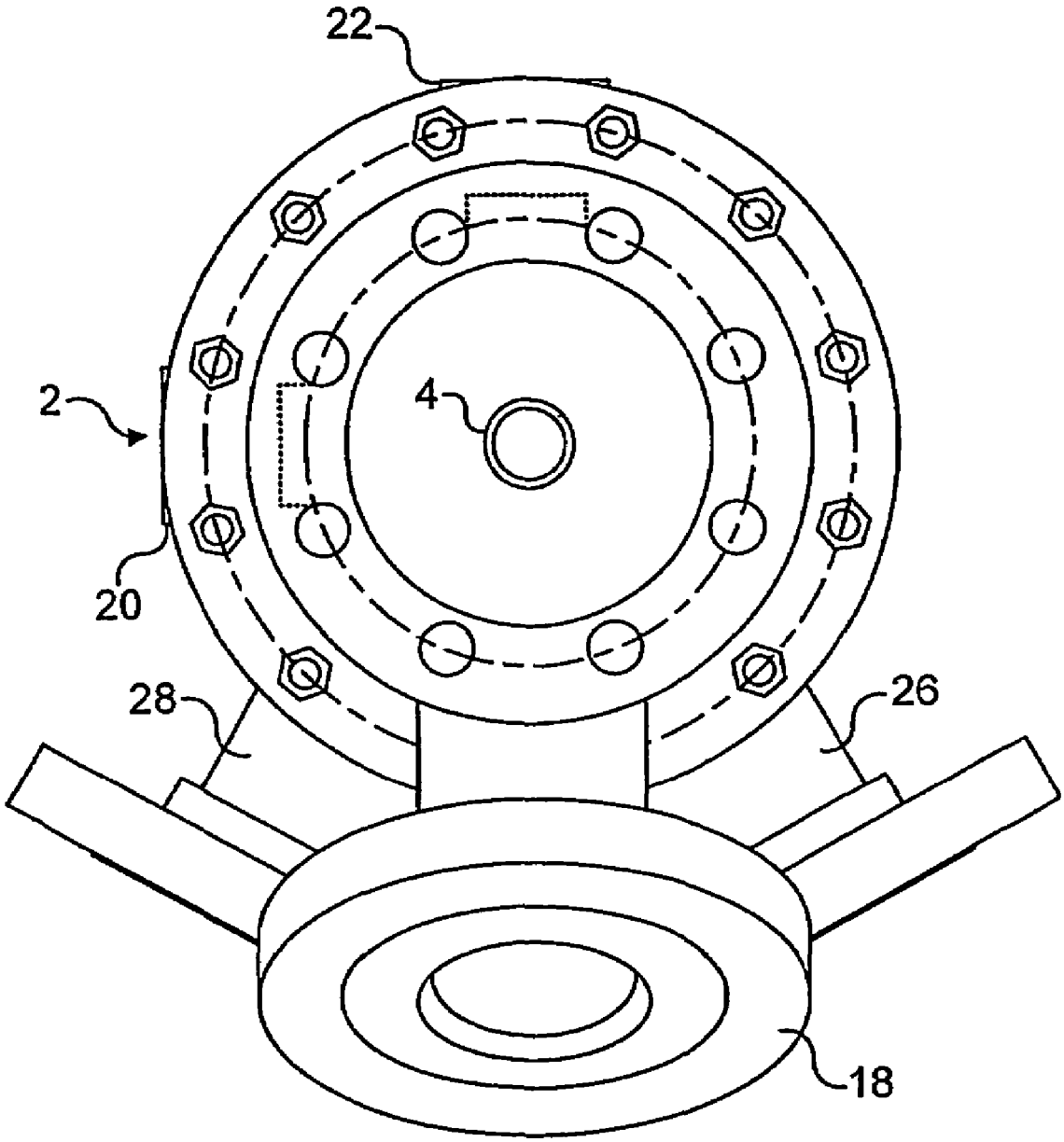

The method according to the present invention will now be described by way of example with reference to the accompanying drawings, in which:

FIG. 1 is a side elevation, partly in section, of a lance for use in the method according to the invention, FIG. 2 is a view of the lance shown in FIG. 1 from its proximal end.

Referring to FIGS. 1 and 2, the metallurgical lance 2 comprises an array of six coaxial tubes or pipes. In sequence, from the innermost tube to the outermost tube, there is a particulate material transport tube 4, a main gas tube 6, an inner tube 8 for water, a tube 10 for fuel gas, a tube 12 for oxidants and an outer tube 14 for water. Each of the tubes 4, 6, 8, 10, 12 and 14 has an inlet at or near the proximal end of the lance 2. In addition, there are outlets from the inner water tube 8 and the outer water tube 14. Thus, there is an axial inlet 16 at the proximal end of the lance 2 for a carrier gas, typically air, employed to transport the particulate material to the distal end of the lance 2. The inlet 16 may include passages (not shown) for introducing the particulate material into the carrier gas. The carrier gas may be supplied at a relatively low pressure such that its velocity along the particulate material transport tube 4 is no more than about 100 metres per second. The solid particulate material is therefore transported along the tube 4 as a so-called "dilute phase". Alternatively, the solid particulate material may be transported as a "dense phase" at a lower velocity. Such dense phase transport is typically preferred if the solid particulate reagent is formed of a hard, abrasive material. On the other hand, dilute phase transport may be preferred for softer materials.

The main gas tube 6 has an inlet 18. Typically, the main gas is oxygen or oxygen-enriched air and the inlet 18 communicates with a source of such oxygen or oxygen-enriched air. The inner water tube 8 has an inlet 20 and an outlet 22 for the water. The tube 8 is provided with a tubular baffle 24. In operation, cooling water passes over the outside surface of the baffle 24 as it flows from the proximal to the distal end of the lance 2 and returns in the opposite direction to the outlet 22 over the inner surface of the baffle 24. The provision of the inner cooling water protects the inner parts of the lance 2 from the effects of the high temperature environment in which it operates.

The fuel gas tube 10 communicates at its proximal end through an inlet 26 with a source (not shown) of fuel gas (typically, natural gas). Similarly, an inlet 28 places the oxidant tube 12 in communication with a source (not shown) of oxidant, typically oxygen or oxygen-enriched air. The outer water tube 14 communicates at its distal end with another inlet 30 for cooling water. The outer tube 14 contains a tubular baffle 32. The arrangement is such that coolant water flows through the inlet 30 and passes over the outer surface of the baffle 32 as it flows from the proximal to the distal end of the lance 2. The cooling water returns in the opposite direction and flows away through an outlet 34 at the proximal end of the lance 2. The outer water tube 14 enables the outer parts of the lance 2 to be cooled during its operation in a high temperature environment. The fuel gas tube 10 and the oxidant tube 12 terminate further away from the distal end of the lance 2 than the other tubes. The tubes 10 and 12 terminate in a nozzle 35 at the proximal end of a combustion chamber 36. In operation, the oxidant and fuel gas pass through the nozzle 35 and mix and combust in the combustion chamber 36.

The main gas tube 6 provides the passage for the main gas flow through the lance 2. The main gas tube 6 terminates in a first or inner Laval nozzle 38. As shown in FIG. 1, the Laval nozzle 38 has an upstream region that converges towards a throat, and a downstream region that diverges from the throat. At its distal end the Laval nozzle 38 has a further region that converges in the direction of flow. The first Laval nozzle 38 has an annular cooling passage 40 formed therein. The cooling passage 40 is contiguous with an inner water passage defined between the inner surface of the tube 8 and the outer surface of the main gas tube 6. The baffle 24 extends into the passage 40 so as to direct the flow of water coolant. The combustion chamber 36 terminates at its distal end in a second or outer Laval nozzle 42. The second Laval nozzle 42 is formed as a double-walled member. The outer wall of the second Laval nozzle 42 is contiguous with the distal end of the outermost tube 14. The outermost tube 14 is thus able to provide cooling to the second Laval nozzle 42 in operation of the lance 2, the baffle 32 extending into the annular space defined by the inner and outer walls of the Laval nozzle 42. The first or inner Laval nozzle 38 is set back relative to the second or outer Laval nozzle 42. The outlet of the innermost tube 4 is also set back relative to the tip of the first Laval nozzle 38 and terminates in the divergent region or (as shown in FIG. 1) the further convergent region of the Laval nozzle 38.

In operation, the relative rates of supply of the fuel gas and the oxidant to the combustion chamber 36 are typically selected so as to give stoichiometric combustion. If desired, however, the rates may be selected so as to give sub-stoichiometric combustion with the result that the mole fraction of carbon monoxide in the combustion products is greater than in stoichiometric combustion. Alternatively, the combustion may be superstoichiometric with the result that the combustion products contain molecular oxygen. The supply pressures of the oxidant and fuel gas are selected so as to give the desired gas or flame velocity at the exit of the Laval nozzle 42. The exit velocity depends not only on the supply pressures but also the extent of combustion in the chamber 36. Typically, the combustion chamber 36 is of sufficient volume for most of the combustion to take place within it rather than downstream of it. Typically, if the fuel is natural gas it may be supplied at a pressure of at least 5 bar. The oxygen is typically supplied at a pressure of at least 11 bar. The exit velocity of the main gas from the Laval nozzle 38 is typically selected to be in the range of Mach 2 to Mach 3. Carrier gas containing particulate material passes out of the distal end of the tube 4 into the accelerating main gas jet at a region in the divergent region or (as shown in FIG. 1) the further convergent region of the inner Laval nozzle 38. The particulate material is thus carried out of the Laval nozzle 38 at supersonic velocity. The position of the distal end of the tube 4 is such that although the particulate material is introduced into the main gas jet while the latter is accelerating, there is a minimal attrition of the particles against the walls of the inner Laval nozzle 38. The main gas jet is shrouded by an annular supersonic flow of burning hydrocarbon gas exiting the combustion chamber 36. The exit velocity of the burning hydrocarbon gas flame from the Laval nozzle is from 90 to 110%, preferably from 100 to 110%, of the exit velocity of the main gas jet. By adopting similar exit velocities, mixing of the main gas jet and its flame shroud is kept down.

The metallurgical lance shown in the drawings is simple to fabricate. The Laval nozzles 38 and 42 may be attached to the lance 2 by means of suitable welds. The nozzle 34 at the inlet to the combustion chamber 36 may also be welded into position.

In use, the metallurgical lance is typically positioned with its axis vertical in a position a suitable vertical distance above the surface of a metallurgical liquid (e.g. molten metal) into which it is desired to introduce a chosen particulate material (e.g. carbon). The vertical distance is typically selected such that the particulate material is carried into the molten metal at supersonic velocity. In this way, it is able to penetrate deep into the liquid, thus facilitating its chemical or metallurgical reaction with the liquid. Alternatively the axis of the lance may be at an angle to the vertical.

The invention claimed is:

1. A method of introducing a solid particulate reagent into a bath of metallurgical liquid, comprising: introducing a solid particulate reagent into a main supersonic gas jet, directing the main supersonic gas jet at a surface of the bath, and surrounding the main supersonic gas jet with a jet of shrouding gas, characterized in that the shrouding gas jet is ejected from a converging-diverging nozzle at supersonic velocity, the main supersonic gas jet is at a first velocity and the shrouding gas jet at a second velocity, the second velocity being equal to or greater than the first velocity, and the shrouding gas jet comprises a burning hydrocarbon fluid fuel.

2. The method according to claim 1, wherein a flame created by the burning hydrocarbon fluid fuel terminates at the surface of the bath.

3. The method according to claim 1, wherein the main supersonic gas jet issues from a converging-diverging nozzle.

4. The method according to claim 1, wherein the main supersonic gas jet and the shrouding gas jet are provided at a velocity in the range of Mach 1.5 to 4.

5. The method according to claim 4, wherein the velocity is in the range of Mach 2 to 3.

6. The method according to claim 1, wherein the main supersonic gas jet includes a gas comprising at least 70% by volume of a gas selected from the group consisting of free oxygen, air, argon and nitrogen.

7. The method according to claim 3, wherein the jet of shrouding gas is ejected from another converging-diverging nozzle.

* * * * *

UNITED STATES PATENT AND TRADEMARK OFFICE

CERTIFICATE OF CORRECTION

PATENT NO. : 7,591,876 B2
APPLICATION NO. : 10/512187
DATED : September 22, 2009
INVENTOR(S) : Andrew Miller Cameron et al.

It is certified that error appears in the above-identified patent and that said Letters Patent is hereby corrected as shown below:

Col. 2, between lines 5-6, insert a paragraph as follows -- The shrouding gas jet preferably comprises a burning hydrocarbon fluid fuel. The resulting flame preferably terminates at the surface of the bath. --

Signed and Sealed this

Tenth Day of November, 2009

David J. Kappos

David J. Kappos
*Director of the United States Patent and Trademark Office*